US006888922B2

(12) United States Patent
Schaefer et al.

(10) Patent No.: US 6,888,922 B2
(45) Date of Patent: May 3, 2005

(54) FILAMENT CIRCUIT RESISTANCE ADJUSTING APPARATUS TECHNICAL FIELD

(75) Inventors: Thomas D. Schaefer, Milwaukee, WI (US); Lloyd Wang, Brookfield, WI (US); Gregory Steinlage, Milwaukee, WI (US); Earl Warden, Delafield, WI (US)

(73) Assignee: GE Medical Systems Global Technology Co., LLC, Waukesha, WI (US)

( * ) Notice: Subject to any disclaimer, the term of this patent is extended or adjusted under 35 U.S.C. 154(b) by 644 days.

(21) Appl. No.: 09/682,782

(22) Filed: Oct. 18, 2001

(65) Prior Publication Data

US 2003/0086532 A1 May 8, 2003

(51) Int. Cl.[7] ..... H01J 35/10

(52) U.S. Cl. ..... 378/131; 378/121; 315/291; 363/61

(58) Field of Search ..... 315/391, 307; 363/61, 60; 378/102, 131, 141, 121, 122

(56) References Cited

U.S. PATENT DOCUMENTS

| | | | | | |
|---|---|---|---|---|---|
| 3,916,202 | A | * | 10/1975 | Heiting et al. | 378/113 |
| 4,811,375 | A | * | 3/1989 | Klostermann | 378/131 |
| 5,335,161 | A | * | 8/1994 | Pellegrino et al. | 363/61 |
| 5,577,093 | A | | 11/1996 | Benz et al. | 378/144 |
| 5,781,610 | A | * | 7/1998 | Miles | 378/168 |
| 5,875,228 | A | | 2/1999 | Truszkowska | 378/125 |
| 6,760,407 | B2 | * | 7/2004 | Price et al. | 378/122 |

* cited by examiner

*Primary Examiner*—Tuyet Vo
*Assistant Examiner*—Jimmy Vu
(74) *Attorney, Agent, or Firm*—Bill Panagos

(57) ABSTRACT

A filament circuit resistance adjusting apparatus (36), for a filament circuit (38) having a filament (50) with a first resistance is provided. The filament circuit resistance adjusting apparatus (36) includes a first resistor (70), which has a second resistance and is electrically coupled to the filament (50). The first resistor (70) adjusts the resistance of the filament circuit (38). A method for adjusting the resistance of the filament (50) is also provided.

21 Claims, 3 Drawing Sheets

FILAMENT CIRCUIT RESISTANCE ADJUSTING APPARATUS TECHNICAL FIELD

BACKGROUND OF INVENTION

The present invention relates generally to computed tomography systems, and more particularly to an apparatus and method for adjusting the resistance of a cathode filament circuit within a computed tomography tube assembly.

Various computed tomography (CT) systems are presently used, each of which have different system functionality requirements. Because of the different functionality requirements, internal CT system components vary depending upon the application, the manufacturer, and a CT system model.

The CT system includes a computed tomography tube assembly including a CT tube and a filament circuit. The CT tube generates X-rays across a vacuum gap between a cathode and an anode. In order to generate the X-rays, a large voltage potential is created across the vacuum gap forcing electrons to be emitted from the cathode to the anode. In releasing of the electrons, a filament contained within the cathode and filament circuit is heated to incandescence by passing an electric current therein. The electrons are accelerated by the high voltage potential and impinge on the anode, whereby they are abruptly slowed down. The impact of electrons produces a large amount of heat. To reduce the amount of heat in the anode the CT tube is oil cooled. Even in so doing, because of the high voltage and heat generated, CT tubes eventually wear out and need to be replaced.

CT systems have varying resistance requirements for the filament circuit. The bulk of the filament circuit resistance is currently from the filament itself. Therefore, each filament has a resistance that is specific to a CT system. When a filament having a certain resistance is installed into a CT system that requires a filament with a different resistance, system errors can occur such as filament shorts that prevent normal system operation. Since tubes are replaced often and are CT system specific, the cost in production and replacement of the various tubes is large.

Also, when improved and updated CT systems are introduced that require a filament resistance which is different from existing filament resistances, further costs are endured to develop and manufacture a new cathode having the newly required filament resistance.

Therefore, it would be desirable to provide an apparatus for adjusting the resistance of an existing cathode instead of designing a new one. The apparatus may provide versatility and interchangeability of CT tubes between CT systems and reduce the number of different cathodes that are produced, thereby saving costs involved in developing and manufacturing of CT tubes.

SUMMARY OF INVENTION

The foregoing and other advantages are provided by an apparatus and method for adjusting the resistance of a cathode filament circuit within a computed tomography tube. A filament circuit resistance adjusting apparatus, for a filament circuit having a filament with a first resistance is provided. The filament circuit resistance adjusting apparatus includes a first resistor, which has a second resistance and is electrically coupled to the filament. The first resistor adjusts the resistance of the filament circuit. A method for adjusting the resistance of the filament is also provided One of several advantages of the present invention is that it provides an apparatus for adjusting the resistance of an existing filament circuit instead of developing a new CT tube.

Another advantage of the present invention is that it does not detrimentally effect computer tomography (CT) tube performance.

A further advantage of the present invention is that it withstands physical contact with oil, high temperatures, and high X-ray exposure, such as experienced within the CT tube.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

Figure 1:
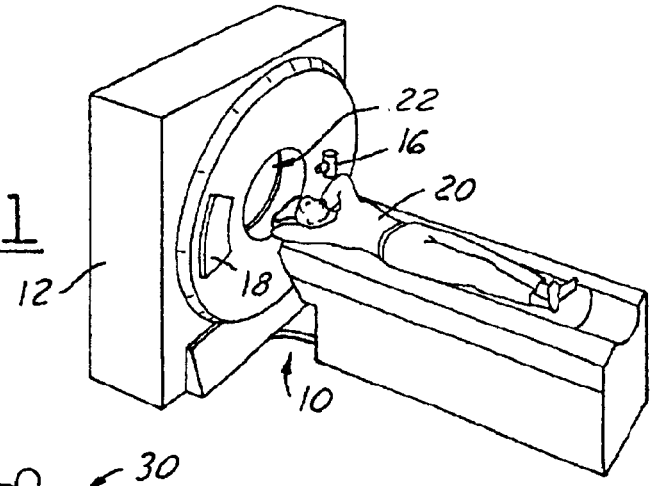
FIG. 1 is a pictorial view of a computed tomography system, utilizing a filament circuit resistance adjusting apparatus in accordance with an embodiment of the present invention.

In each of the following figures, the same reference numerals are used to refer to the same components. While the present invention is described with respect to an apparatus for adjusting the resistance of a cathode filament circuit within a computed tomography (CT) tube, the present invention may be adapted to be used in various systems including: radiotherapy systems, X-ray imaging systems, and other imaging systems that use imaging tubes. Also, the present invention although described as being used in conjunction with a CT tube may be used in conjunction with other imaging tubes including X-ray tubes and camera tubes.

In the following description, various operating parameters and components are described for one constructed embodiment. These specific parameters and components are included as examples and are not meant to be limiting.

Referring now to FIG. 1, a pictorial view of a CT system 10, utilizing a filament circuit resistance adjusting apparatus in accordance with an embodiment of the present invention is shown. The imaging system 10 includes a gantry 12 that has a CT imaging tube assembly 16. The imaging tube 16 projects a beam of x-rays toward a detector array 18. The x-rays after passing through the medical patient 20, within the patient bore 22, are detected and used to create a CT image.

Figure 2A:
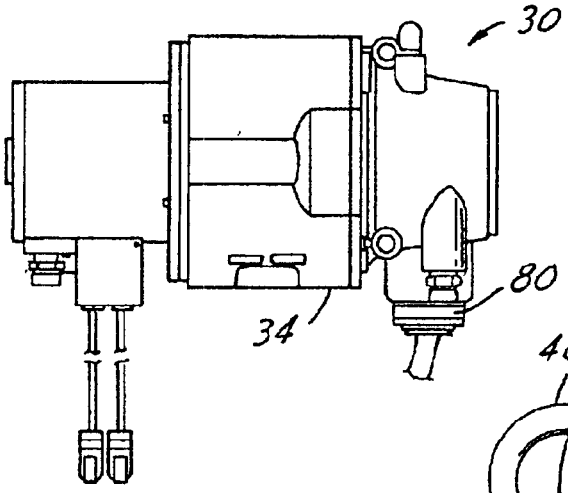
FIG. 2A is a top view of a computed tomography (CT) tube assembly in accordance with an embodiment of the present invention.
Figure 2B:
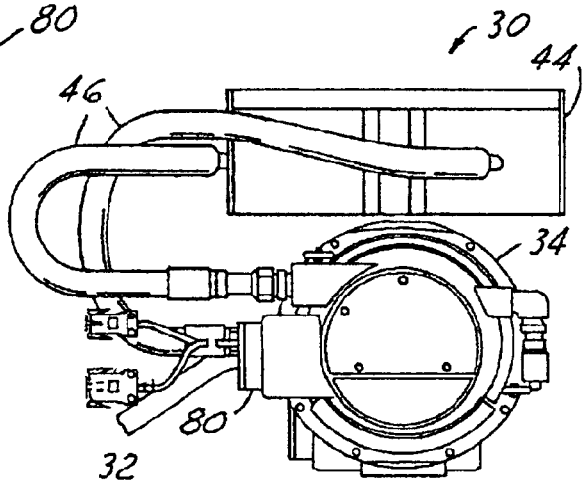
FIG. 2B is a side view of the CT tube assembly in FIG. 2A, which is in accordance with an embodiment of the present invention.
Figure 2C:
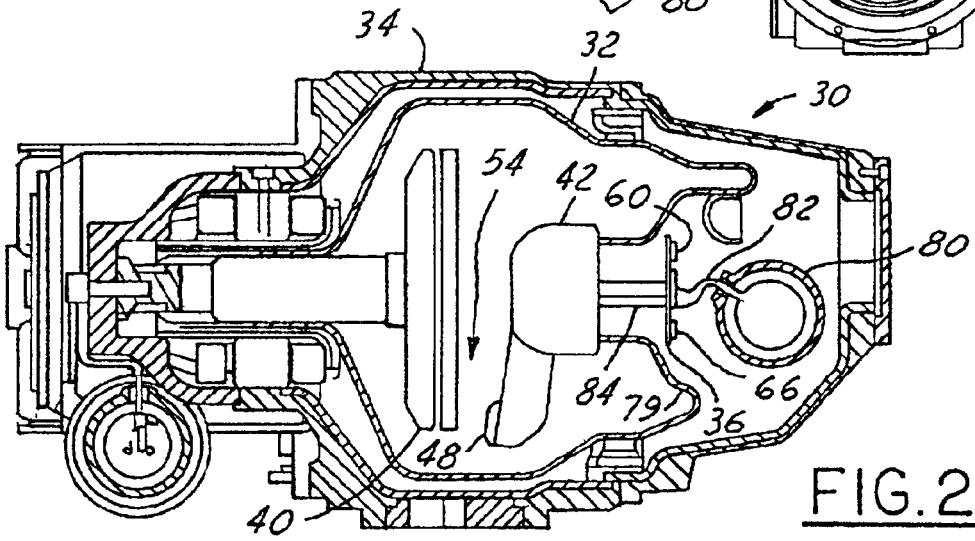
FIG. 2C is a sectional view of the CT tube assembly in FIG. 2A, which is in accordance with an embodiment of the present invention.
Figure 3:
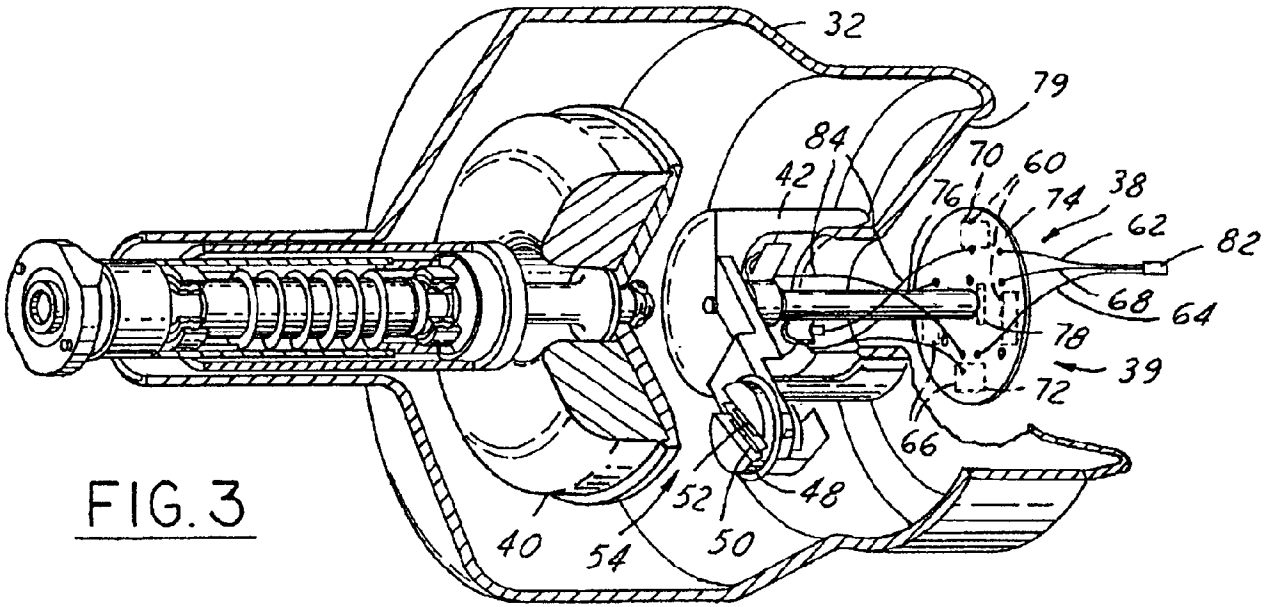
FIG. 3 is a perspective cut away view of a CT tube insert in accordance with an embodiment of the present invention.

Referring now to FIGS. 2A, 2B, and 2C of a top view, a side view, and a cross-sectional front view of a CT tube 30 assembly containing a CT tube 32 and also referring to FIG. 3 of a perspective cut away view of the CT tube insert 32, all of which are shown in accordance with an embodiment of the present invention. The CT tube 32 assembly includes an exterior housing 34 comprising the CT tube insert 32 and a filament circuit resistance adjusting apparatus 36 that is part of a first filament circuit 38, and a second filament circuit 39.

The CT tube insert 32 is formed from glass, which contains a rotating anode 40 and a cathode 42. The CT tube 32 is surrounded by oil, which is pumped to a heat exchanger 44 via hoses 46 where it is cooled. The cathode 42 includes a cathode cup 48 supporting a first filament 50 and a second filament 52. Electrons pass from the filaments 50 and 52 to the rotating anode 40 across a vacuum gap 54 where they impinge on the anode producing x-rays. These x-rays then pass through a window (not shown) in the housing 34 for scanning purposes.

The first filament circuit 38 includes the first filament 50, a first pair of resistors 60 in series with the first filament 50, a first supply line 62, and a common line 64. The second filament circuit 39 includes the second filament 52, a second pair of resistors 66 in series with the second filament 52, a second supply line 68, and the common line 64.

Both the circuits 38 and 39 have an overall resistance that is adjusted by the pairs of resistors 60 and 66, respectively. The first filament 50 may be a tungsten wire, having a first resistance. The first pair of resistors 60 include a first resistor 70 having a second resistance. The second filament 52 may also be a tungsten wire, although it has a third resistance. The second pair of resistors 66 include a second resistor 72 having a fourth resistance. Each resistor in the pairs of resistors 60 and 66 may have varying resistance depending upon the CT system application. Both pairs of resistors 60 and 66 are mounted on a circuit board 74, which is attached to a cathode rod 76 by a threaded fastener 78. Notwithstanding, the circuit board 74 may be fastened to the cathode rod 76 by other means know in the art. Although, the circuit board 74 is illustrated as being circular in shape and having a diameter such that it fits into a recessed portion 79 of the CT tube insert 32 it may be of various size and shape. Also, even though each of the circuits 38 and 39 have a pair of resistors, any number of resistors may be used to achieve the proper overall resistance. The resistors may be in series with, parallel to, or both in series with and parallel to the filaments 50 and 52.

In operation, power is supplied through a cathode receptacle 80 to the pairs of resistors 60 and 66 via the supply lines 62 and 68. The cathode receptacle 80 is located outside of the CT tube insert 32 and is coupled to a high voltage generator and filament drive (not shown) by which the power is supplied to the cathode 42. The supply lines 62 and 68 and the common line 64 are plugged into the cathode receptacle 80 via plug 82. After passing through the pairs of resistors 60 and 66 power passes to the filaments 50 and 52 via filament leads 84, respectively. Power then returns to the cathode receptacle 80 via the common line 64.

Figure 4B:
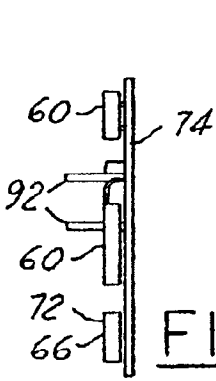
FIG. 4B is a side view of the filament circuit resistance adjusting apparatus in accordance with an embodiment of the present invention.
Figure 4C:
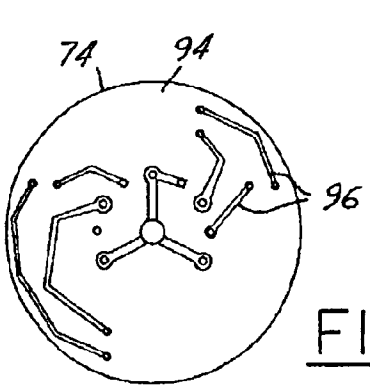
FIG. 4C is a rear view of the filament circuit resistance adjusting apparatus in accordance with an embodiment of the present invention.
Figure 4A:
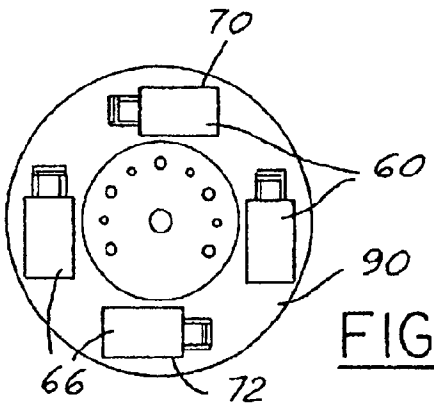
FIG. 4A is a front view of the filament circuit resistance adjusting apparatus in accordance with an embodiment of the present invention.

Referring now to FIGS. 4A, 4B, and 4C of a front view, a side view, and a rear view of the apparatus 36 in accordance with an embodiment of the present invention are shown. The apparatus 36 includes the pairs of resistors 60 and 66, and the circuit board 74.

The pairs of resistors 60 and 66 are referred to as power film resistors in the art. An example of a power film resistor that may be used is the CADDOCK Corporation power resistor, model number MP850. The power film resistors are heat and oil resistant, as to withstand the internal operating environment of the CT tube assembly 30. Of course, for other applications other resistors may be used. Also although the pairs of resistors 60 and 66 are in series with the filaments 50 and 52 to increase the resistance of the circuits 38 and 39, respectively, they may be parallel to the filaments 50 and 52 as to reduce the resistance of the circuits 38 and 39.

The circuit board 74 is also produced from heat and oil resistant materials known in the art. The circuit board 74 has a heat sink layer 90 that may be produced from copper and metalized onto the front surface of the circuit board 74. The heat sink layer 90 aids in transferring heat away from the pairs of resistors 60 and 66. The heat sink layer 90 may be produced from other forms of high heat transfer material know in the art. The circuit board 74 may also have pins 92 for attaching the filament leads 84, the supply lines 62 and 68, or the common line 64 to the circuit board 74. Although, the pins 92 in this example are produced from nickel, they may be produced from a conductive material other than nickel. The rear side 94 of the circuit board 74 has conductive paths 96 metalized therein for transferring power between the filament leads 84, the supply lines 62 and 68, and the common line 64.

Figure 5A:
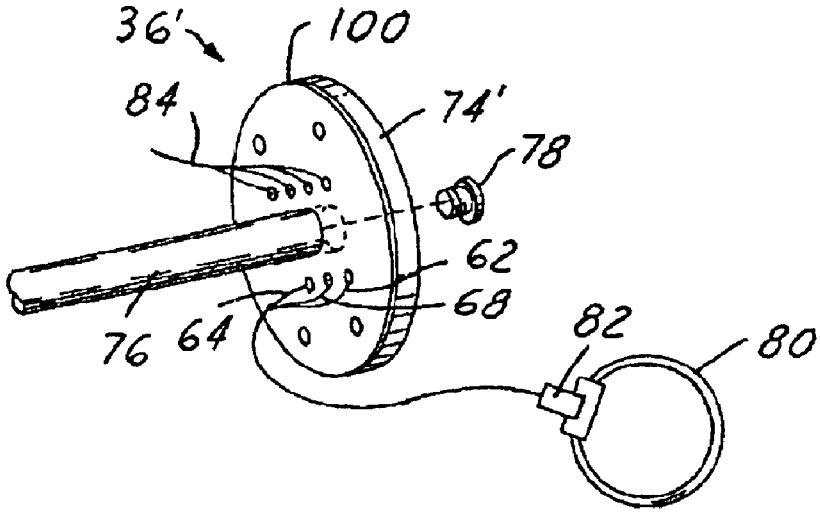
FIG. 5A is a perspective view of a filament circuit resistance adjusting apparatus in accordance with another embodiment of the present invention.
Figure 5B:
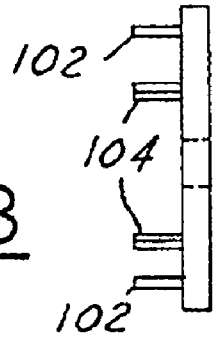
FIG. 5B is a side view of a filament circuit resistance adjusting apparatus in accordance with another embodiment of the present invention.

Referring now to FIGS. 5A and 5B, of a perspective view and a side view of a filament circuit resistance adjusting apparatus 36" in accordance with another embodiment of the present invention are shown. The apparatus 36" includes a filament resistance adjusting apparatus socket 100 and the circuit board 74" with the pairs of resistors 60 and 66 attached. The circuit board 74" may have attachment pins 102 that snap into the socket 100 so as to allow easy removal or replacement of the circuit board 74". Other attachment devices known in the art, other than the attachment pins 102 may also be used. The circuit board 74" may also have contact pins 104 for conductive transfer between the filament leads 84, the supply lines 62 and 68, and common line 64.

Figure 6:
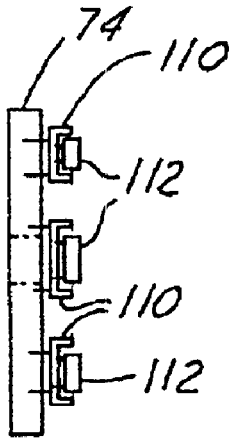
FIG. 6 is a side view of a filament circuit resistance adjusting apparatus in accordance with another embodiment of the present invention.

Now referring to FIG. 6, a side view of a filament circuit resistance adjusting apparatus 36" in accordance with another embodiment of the present invention is shown.

The circuit board 74 may have individual resistor sockets 110 so as to allow the resistors 112, in the pairs of resistors 60 and 66, to be attached to the circuit board 74 without soldering by inserting them into sockets 110. The sockets 110 provide easy removal and replacement of the resistors 112. Thereby, further providing ease in adjusting the resistance of the circuits 50 and 52.

The present invention by providing a filament circuit resistance adjusting apparatus reduces development and production costs involved in satisfying new resistance requirements for future CT systems. The present invention also provides versatility in changing resistance of filament circuits. Furthermore the present invention allows for interchangeability of imaging tubes between various CT systems.

The above-described apparatus, to one skilled in the art, is capable of being adapted for various purposes and is not limited to the following systems: radiotherapy systems, X-ray imaging systems, and other imaging systems that use imaging tubes. The above-described invention may also be varied without deviating from the spirit and scope of the invention as contemplated by the following claims.

What is claimed is:

1. A filament circuit resistance adjusting apparatus, for a filament circuit having a filament with a first resistance, said apparatus comprising a first nonhard-wired and removable resistor electrically coupled to the filament and having a second resistance, said first nonhard-wired and removable resistor adjusting system perceived resistance of the filament.

2. An apparatus as in claim 1 wherein said first nonhard-wired and removable resistor is in series with or parallel to the filament.

3. An apparatus as in claim 1 further comprising one or more resistors electrically coupled to said first nonhard-wired and removable resistor and further adjusting the resistance of the filament circuit.

4. An apparatus as in claim 3 wherein said one or more resistors are in series with, parallel to, or are both in series with and parallel to said first nonhard-wired and removable resistor and the filament.

5. An apparatus as in claim 1 further comprising:

a circuit board electrically coupled to the filament and first nonhard-wired and removable resistor;

wherein said circuit board supports said first nonhard-wired and removable resistor.

6. An apparatus as in claim 5 wherein the circuit board comprises a heat sink layer.

7. An apparatus as in claim 5 further comprising a heat sink coupled to the circuit board and said first nonhard-wired and removable resistor.

8. An apparatus as in claim 5 further comprising a resistor socket electrically coupled to said circuit board and said first nonhard-wired and removable resistor, wherein said first nonhard-wired and removable resistor plugs into said socket.

9. An apparatus as in claim 5 further comprising a filament resistance adjusting apparatus socket electrically coupled to the filament and the circuit board, wherein said circuit board plugs into said filament resistance adjusting apparatus socket.

10. A filament resistance adjusting apparatus, for a first filament circuit having a first filament with a first resistance, said apparatus comprising:

a circuit board electrically coupled to the first filament; and a first nonhard-wired and removable resistor electricaily coupled to said circuit board and the first filament and having a second resistance, said first nonhard-wired and removable resistor is in series with the first filament and adjusting the resistance of the first filament circuit.

11. An apparatus as in claim 10 further comprising:

a second filament having a third resistance; and a second nonhard-wired and removable resistor having a fourth resistance, said second nonhard-wired and removable resistor is electrically coupled to said second filament and said circuit board;

said second nonhard-wired and removable resistor is in series with the second filament and adjusting the resistance of the second filament circuit.

12. An imaging tube assembly having a filament circuit comprising:

a cathode comprising a filament; and a filament circuit resistance adjusting apparatus comprising;

a circuit board electrically coupled to the filament; and a first nonhard-wired and removable resistor electrically coupled to said circuit board and the filament and having a second resistance, said first nonhard-wired and removable resistor adjusting system perceived resistance of the filament.

13. An apparatus as in claim 12 further comprising:

imaging tube encasing having a recessed portion;

wherein said filament circuit resistance adjusting apparatus is positioned within said recessed portion.

14. An apparatus as in claim 12 further comprising a filament circuit resistance adjusting apparatus socket electrically coupled to the filament and the circuit board, wherein said circuit board plugs into said socket.

15. An apparatus as in claim 14 further comprising a cathode receptacle electrically coupled to said filament circuit resistance adjusting apparatus socket.

16. An apparatus as in claim 12 further comprising a resistor socket electrically coupled to said circuit board and said first nonhard-wired and removable resistor.

17. A method of adjusting resistance of a filament circuit having a filament with a first resistance, said method comprising:

directly and electrically coupling a first nonhard-wired and removable resistance device, having a second resistance, to the filament such that system perceived resistance of the filament is altered;

unplugging said first nonhard-wired and removable resistance device; and plugging in a second nonhard-wired and removable resistance device in replacement of said first nonhard-wired and removable resistance device.

18. An apparatus as in claim 5 wherein said circuit board is configured to reside within an encasing of an imaging tube.

19. An apparatus as in claim 5 wherein said circuit board is configured to be nonhard-wired and removable from an imaging tube.

20. An assembly as in claim 12 wherein said circuit board is configured to be nonhard-wired and removable from an imaging tube.

21. An assembly as in claim 12 wherein said filament circuit resistance adjusting apparatus is attached and part of an imaging tube of the imaging tube assembly.

* * * * *

UNITED STATES PATENT AND TRADEMARK OFFICE

CERTIFICATE OF CORRECTION

PATENT NO. : 6,888,922 B2
APPLICATION NO. : 09/682782
DATED : May 3, 2005
INVENTOR(S) : Thomas D. Schaefer et al.

It is certified that error appears in the above-identified patent and that said Letters Patent is hereby corrected as shown below:

Column 5, line 35, should read as follows:

-- a circuit board electrically coupled to the filament and said first --

Signed and Sealed this

Twenty-fourth Day of April, 2007

JON W. DUDAS
*Director of the United States Patent and Trademark Office*